US010245736B2

(12) United States Patent
Huang

(10) Patent No.: US 10,245,736 B2
(45) Date of Patent: Apr. 2, 2019

(54) AUTOMATICALLY RETRACTABLE CUTTER

(71) Applicant: ORANGE HARDWARE COMPANY, Taichung (TW)

(72) Inventor: Tien-Yu Huang, Taichung (TW)

(73) Assignee: ORANGE HARDWARE COMPANY, Taichung (TW), `

( * ) Notice: Subject to any disclaimer, the term of this patent is extended or adjusted under 35 U.S.C. 154(b) by 33 days.

(21) Appl. No.: 15/582,002

(22) Filed: Apr. 28, 2017

(65) Prior Publication Data

US 2018/0311839 A1 Nov. 1, 2018

(51) Int. Cl.
*B26B 5/00* (2006.01)
*B26B 1/08* (2006.01)

(52) U.S. Cl.
CPC ..... *B26B 5/003* (2013.01); *B26B 1/08* (2013.01)

(58) Field of Classification Search
CPC ..... B26B 5/003; B26B 5/001; B26B 5/00; B26B 5/006; B26B 1/08; B26B 3/06; F41B 13/02; A61B 2017/32113
USPC ..... 30/162, 154, 164, 329, 335, 336, 337, 30/151, 2, 272.1
See application file for complete search history.

(56) References Cited

U.S. PATENT DOCUMENTS 4,683,656 A * 8/1987 Peyrot ..... B26B 5/003 30/151
5,303,474 A * 4/1994 Keklak ..... B26B 5/003 30/125
6,148,520 A * 11/2000 Berns ..... B26B 5/003 30/162
8,307,556 B2 * 11/2012 Davis ..... B26B 5/003 30/162
8,997,358 B2 * 4/2015 Huang ..... B26B 1/08 30/162
2004/0237312 A1 * 12/2004 Hernandez ..... B26B 5/001 30/162
2008/0052913 A1 * 3/2008 Cheng ..... B26B 5/00 30/157
2010/0088900 A1 * 4/2010 Davis ..... B26B 5/003 30/162

FOREIGN PATENT DOCUMENTS

TW I466763 * 1/2015 ..... B26B 1/08

* cited by examiner

*Primary Examiner* — Evan MacFarlane

(57) ABSTRACT

A cutter includes a handle, a cassette and a sliding element. The handle includes a slot in an end and two grooves in two opposite internal faces. The cassette includes two bosses and a catch. The bosses are inserted in the grooves to allow the cassette to translate and pivot. The catch is formed on the cassette. The sliding element includes a fin, and is movable in the handle between a rear position and a front position. In the rear position, the fin is separated from the catch and the cassette is far from the slot. In the front position, the fin is in contact with the catch and the cassette is located near the slot. The catch is abutted against the fin so that the cassette is moved forward in the handle while the sliding element is moved to the front position from the rear position.

14 Claims, 14 Drawing Sheets

AUTOMATICALLY RETRACTABLE CUTTER

BACKGROUND OF INVENTION

1. Field of Invention

The present invention relates to a cutter and, more particularly, to an automatically retractable cutter.

2. Related Prior Art

U.S. Pat. No. 6,148,520 discloses a cutter including two slides 15 and 27. The slide 15 is made with a notch 36. A leaf spring 34 is connected to the slide 27. The leaf spring 34 is normally at a distance from the notch 36. The slide 27 is movable relative to the slide 15 to insert the leaf spring 34 in the notch 36. Then, the slide 27 moves the slide 15. Hence, the slide 15 extends a blade 14 from a housing 11 of the cutter. The blade 14 is sharp and can cut neatly into a work-piece 45 such as a cardboard. The blade 14 contacts the work-piece 45 and reduces the cutting speed so that the slide 15 moves slower than the slide 27. That is, the slide 15 moves relative to the slide 27. Finally, the leaf spring 34 is removed from the notch 36, and the slide 15 is moved backward in the housing 11 by a spring 20 that connects the slide 15 to an internal portion of the housing 11. Hence, the blade 14 is automatically retracted into the housing 11. However, the slide 27 is inclined when it is moved. The housing 11 must be made large to encompass the slide 27. Moreover, the blade 14 is unstable during movement or cutting.

Taiwanese Patent No. 1466763 discloses a cutter including a handle, a holder 10, a pivotal element 30 and an operative element 60. The handle includes two shells 40 and 50. The shell 40 includes a hook 44. The shell 50 includes two abutment elements 55. The pivotal element 30 is connected to the holder 10. A blade 20 is held by the holder 10. The pivotal element 30 includes a hook 35 hooking an end of a spring 46 while the hook 44 hooks another end of the spring 46. Thus, the pivoting of the pivotal element 30 is limited, and the pivotal element 30 is in contact with a the pusher 63 formed on the operative element 60. Hence, when the operative element 60 is moved relative to the handle, the pivotal element 30 is moved by the pusher 63, and a leading tip of the blade 20 is moved out of the holder to cut a work-piece. Each of the abutment elements 55 includes a slope 551. In cutting, the tip of the blade 20 cuts into the work-piece so that the blade 20, the holder 10 and the pivotal element 30 are moved slower than the handle. That is, the blade 20, the holder 10 and the pivotal element 30 are moved relative to the handle. The pivotal element 30 is moved on the slopes 551 and eventually removed from the pusher 63. That is, the holder 10 is disconnected from the operative element 60. Hence, another spring 54 that connects the pivotal element 30 to the handle is allowed to retract the blade 20 into the handle. However, after some time of use, the spring 46 will suffer fatigue and cannot adequately pivot the pivotal element 30 to abut against the pusher 63. Hence, the extension of the blade 20 from the handle might be jeopardized.

The present invention is therefore intended to obviate or at least alleviate the problems encountered in prior art.

SUMMARY OF INVENTION

It is an objective of the present invention to provide an automatically retractable cutter.

It is another objective of the present invention to provide a safe and reliable automatically retractable cutter.

To achieve the foregoing objectives, the cutter includes a handle, a cassette and a sliding element. The handle includes a slot in an end and two grooves in two opposite internal faces. The cassette includes two bosses and a catch. The bosses are inserted in the grooves to allow the cassette to translate and pivot. The catch is formed on the cassette. The sliding element includes a fin, and is movable in the handle between a rear position and a front position. In the rear position, the fin is separated from the catch and the cassette is far from the slot. In the front position, the fin is in contact with the catch and the cassette is located near the slot. The catch is abutted against the fin so that the cassette is moved forward in the handle while the sliding element is moved to the front position from the rear position.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
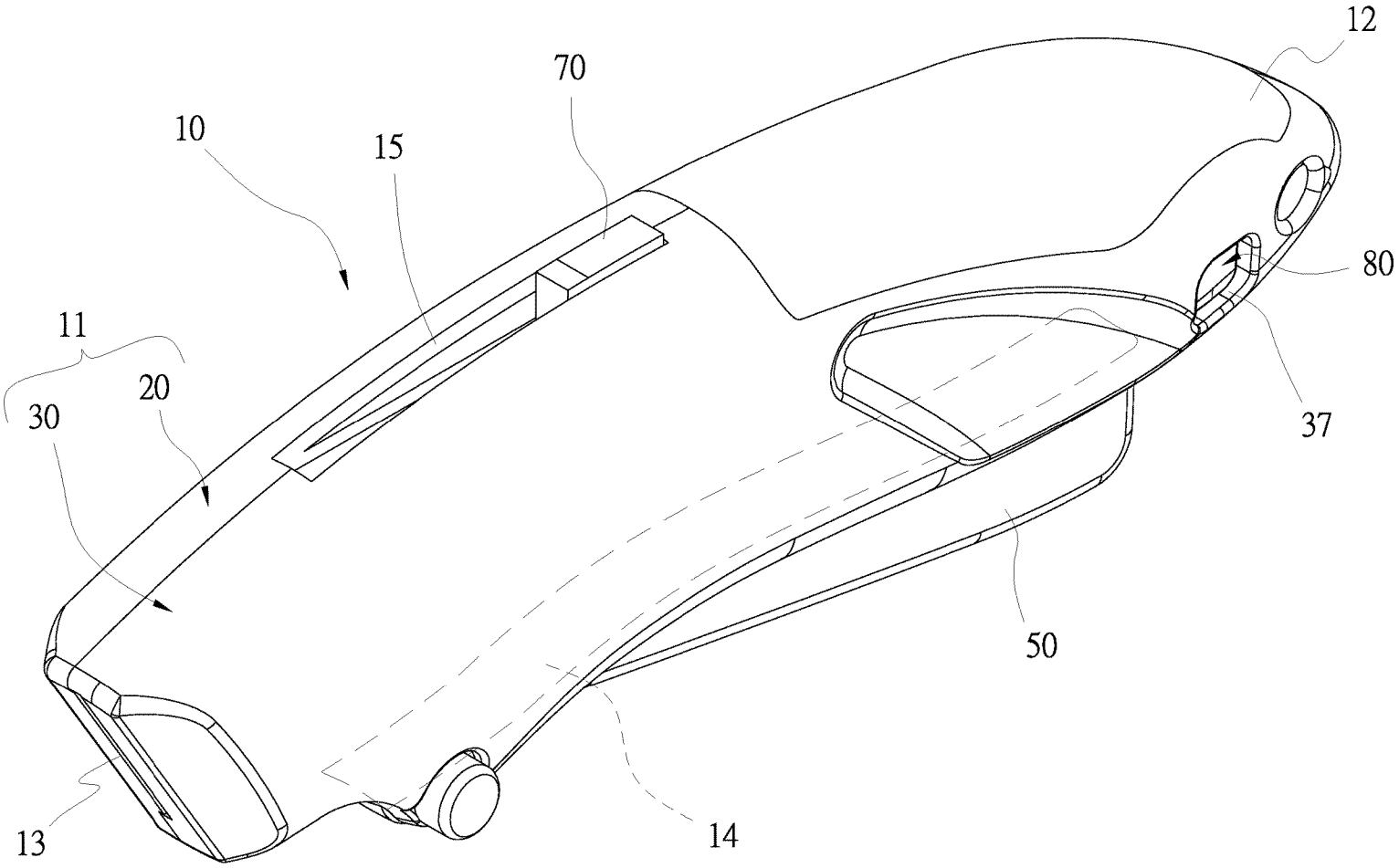
FIG. 1 is a perspective view of an automatic retractable cutter according to the preferred embodiment of the present invention.
Figure 2:
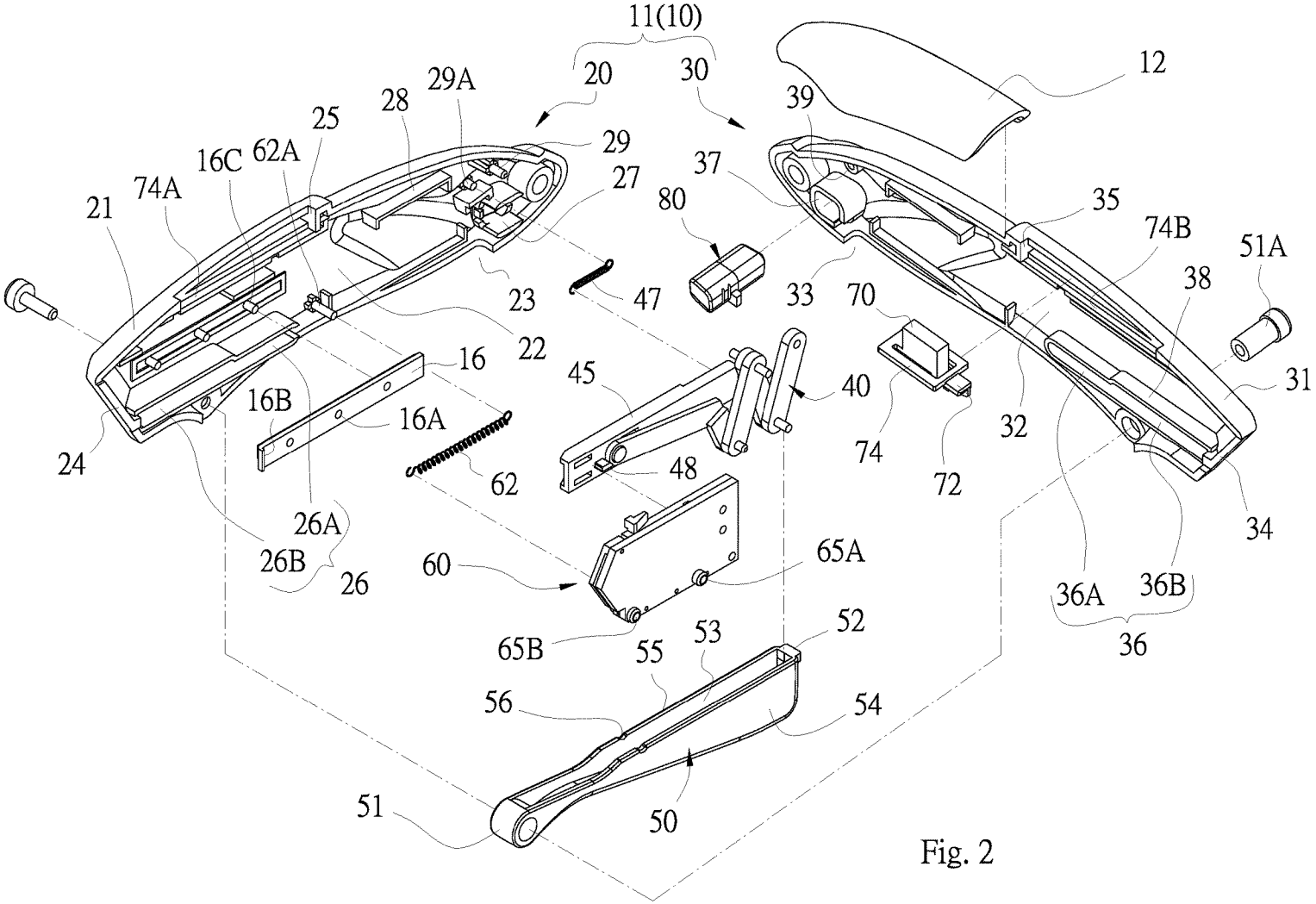
FIG. 2 is an exploded view of the automatic retractable cutter shown in FIG. 1.
Figure 15:
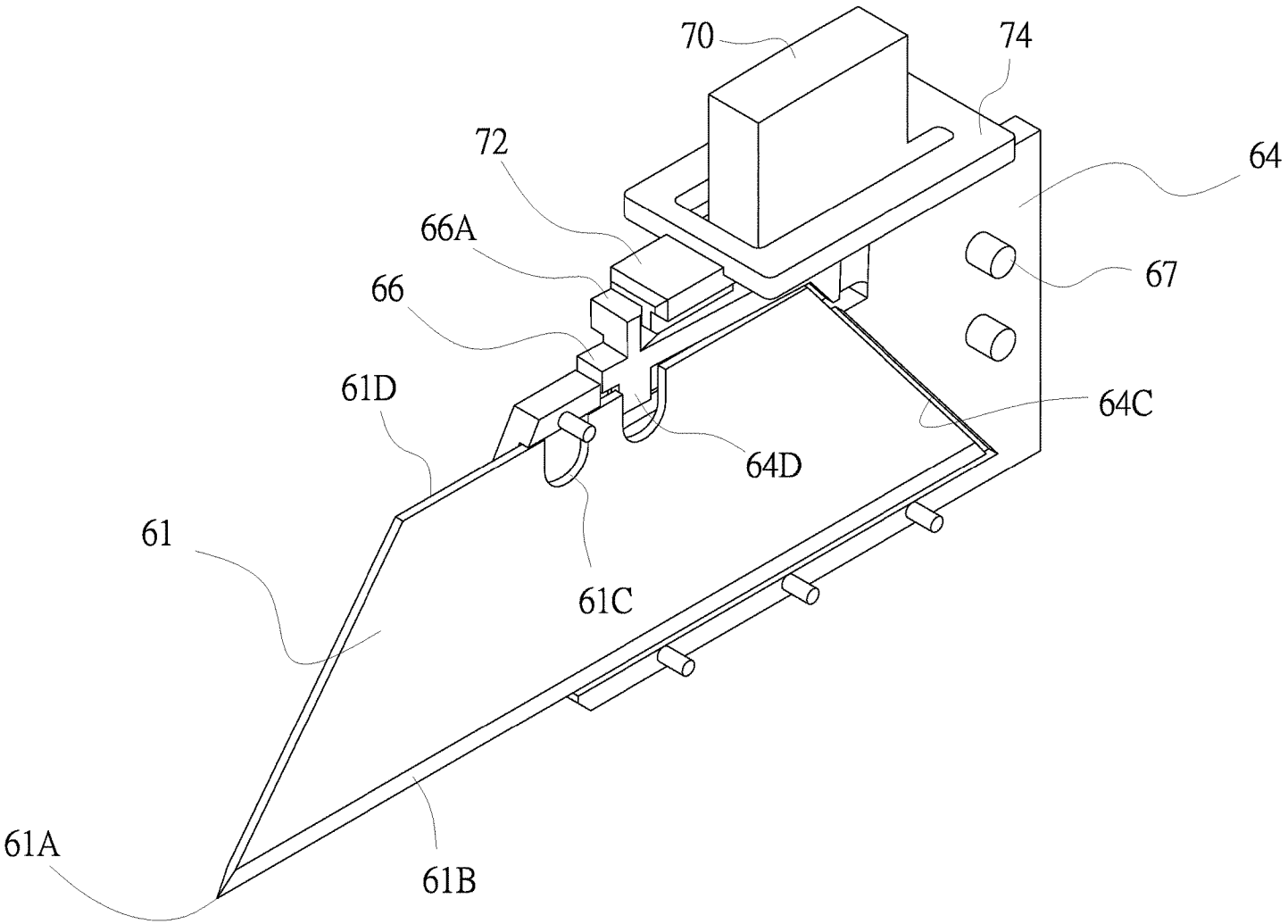
FIG. 15 is a perspective view of a blade and a portion of the cassette shown in FIG. 9.

Referring to FIGS. 1 and 2, a cutter 10 includes a handle 11, a track 16, a linkage 40, a sliding element 45, a lever 50, a cassette 60, a switch 70 and a safety element 80 according to the preferred embodiment of the present invention. The cutter 10 further includes a blade 61 (FIG. 15). The blade 61 is formed with a tip 61A, a cutting edge 61B extending from the tip 61A, an upper edge 61D opposite to the cutting edge 61B, and two cutouts 61C made in the upper edge 61D. In storage, the entire blade 61 is inserted in the handle 11. In use, the tip 61A and a portion of the cutting edge 61B are extended from the handle 11.

The handle 11 is a hollow element including a slot 13 in a front portion, an opening 14 in a lower portion, and a slit 15 in an upper portion. A cover 12 is provided on a lower portion of the handle 11. The cover 12 is made of a plastic material, rubber or a polymer so that it is softer than the handle 11. The cover 12 provides a user with a soft and comfortable touch when the user holds the handle 11. The handle 11 is made by connecting two shells 20 and 30 to each other.

Figure 18:
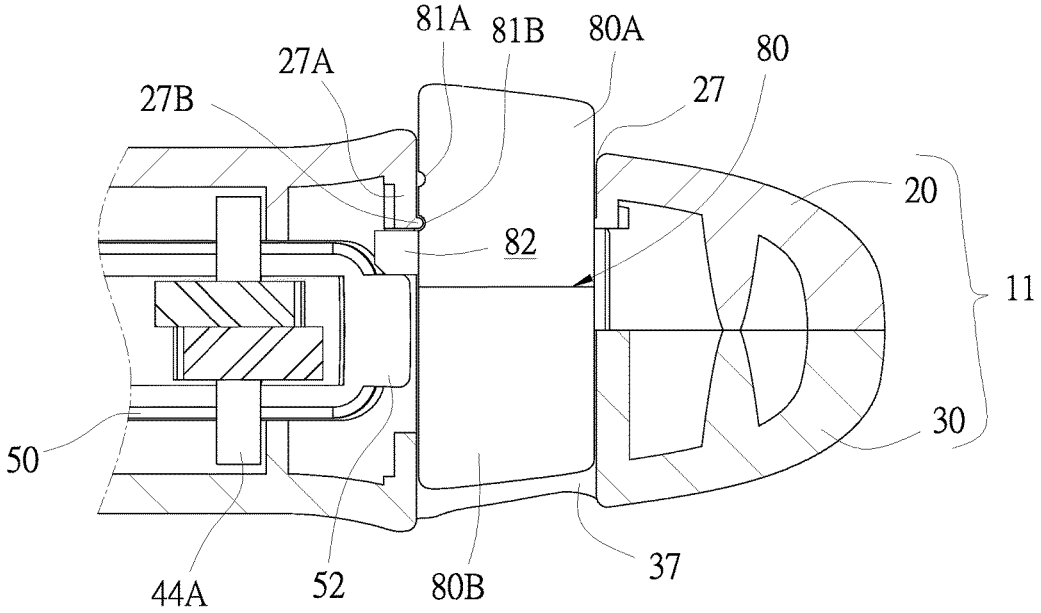
FIG. 18 is an enlarged partial, cross-sectional view of the automatic retractable cutter, showing the switch in a position.
Figure 19:
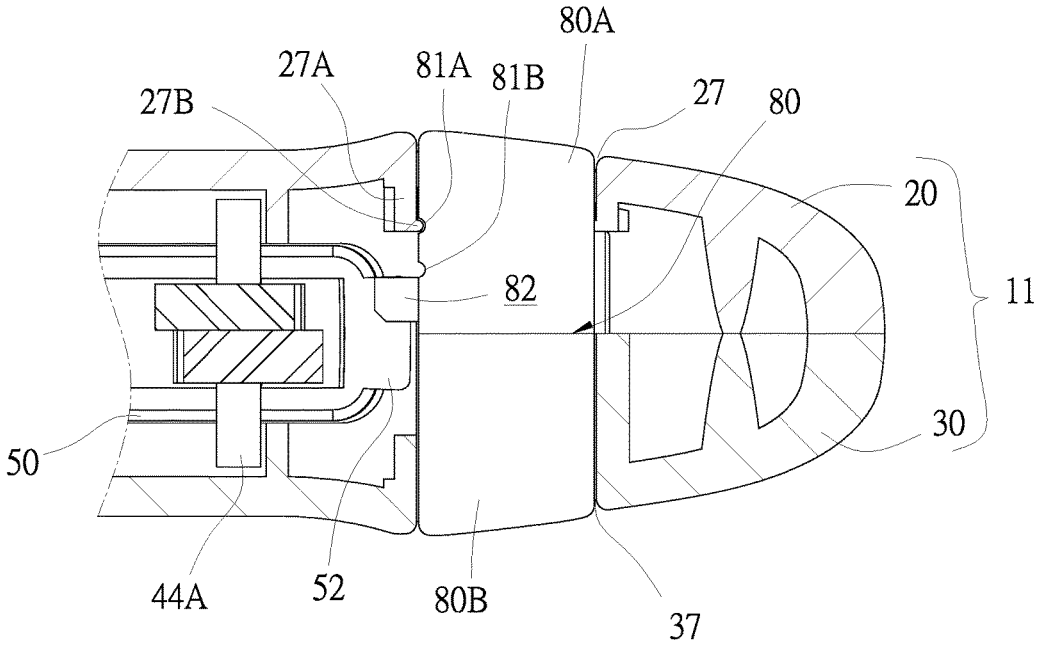
FIG. 19 is an enlarged partial, cross-sectional view of the automatic retractable cutter, showing the switch in another position.

The shell 20 includes a wall 21, a space 22 in the wall 21, three cutouts 23, 24 and 25 at an edge of the wall 21, and a polygonal aperture 27 throughout the wall 21. The shell 20 further includes ribs 28 extending on an internal face of the wall 21. Some of the ribs 28 reinforce the shell 20. Two other ribs 28 make a groove 74A. Two other ribs 28 make a groove 26. The groove 26 includes a narrow section 26A in communication with a wide section 26B. Referring to FIGS. 18 and 19, the shell 20 further includes a positioning portion 27A formed on the wall of the polygonal aperture 27 and a boss 27B formed on the positioning portion 27A.

The shell 30 includes a wall 31, a space 32 in the wall 31, three cutouts 33, 34 and 35 at an edge of the wall 31, and a polygonal aperture 37 throughout the wall 31. The shell 30 includes ribs 38 extending on an internal face of the wall 31. Some of the ribs 38 reinforce the shell 30. Two other ribs 38 make a groove 36. Two other ribs 38 make a groove 74B. The groove 36 includes a narrow section 36A in communication with a wide section 36B.

With the shells 20 and 30 interconnected, the spaces 22 and 32 are made one. The cutouts 24 and 34 together provide the slot 13. The cutouts 23 and 33 together provide the opening 14. The cutouts 25 and 35 together provide the slit 15. The groove 26 is aligned with the groove 36. The cassette 60 is located between the grooves 26 and 36.

The sliding element 45 is movable in the handle 11 between a rear position (FIG. 3) and a front position (FIG. 10) by movably supporting the sliding element 45 on a track 16 attached to the shell 20. To this end, several apertures 16A are made in the track 16. Several stems 16C are formed on the internal face of the wall 21 of the shell 20. The stems 16C are inserted in the apertures 16A. The track 16 includes a stop 16B formed on a side, near an end. Referring to FIG. 4, the sliding element 45 includes a groove (not numbered) to receive the track 16. The stop 16B can be used to limit the movement of the sliding element 45 in a range.

Referring to FIGS. 2 and 4 to 6, a spring 47 is arranged between the sliding element 45 and the shell 20. To this end, the sliding element 45 includes a rod 45A, and the shell 20 includes a stem 29A formed on the internal face of the wall 21. The spring 47 is preferably a tensile spring including an end connected to the rod 45A and another end connected to the stem 29A. The spring 47 tends to move the sliding element 45 to the rear position from the front position.

Figure 3:
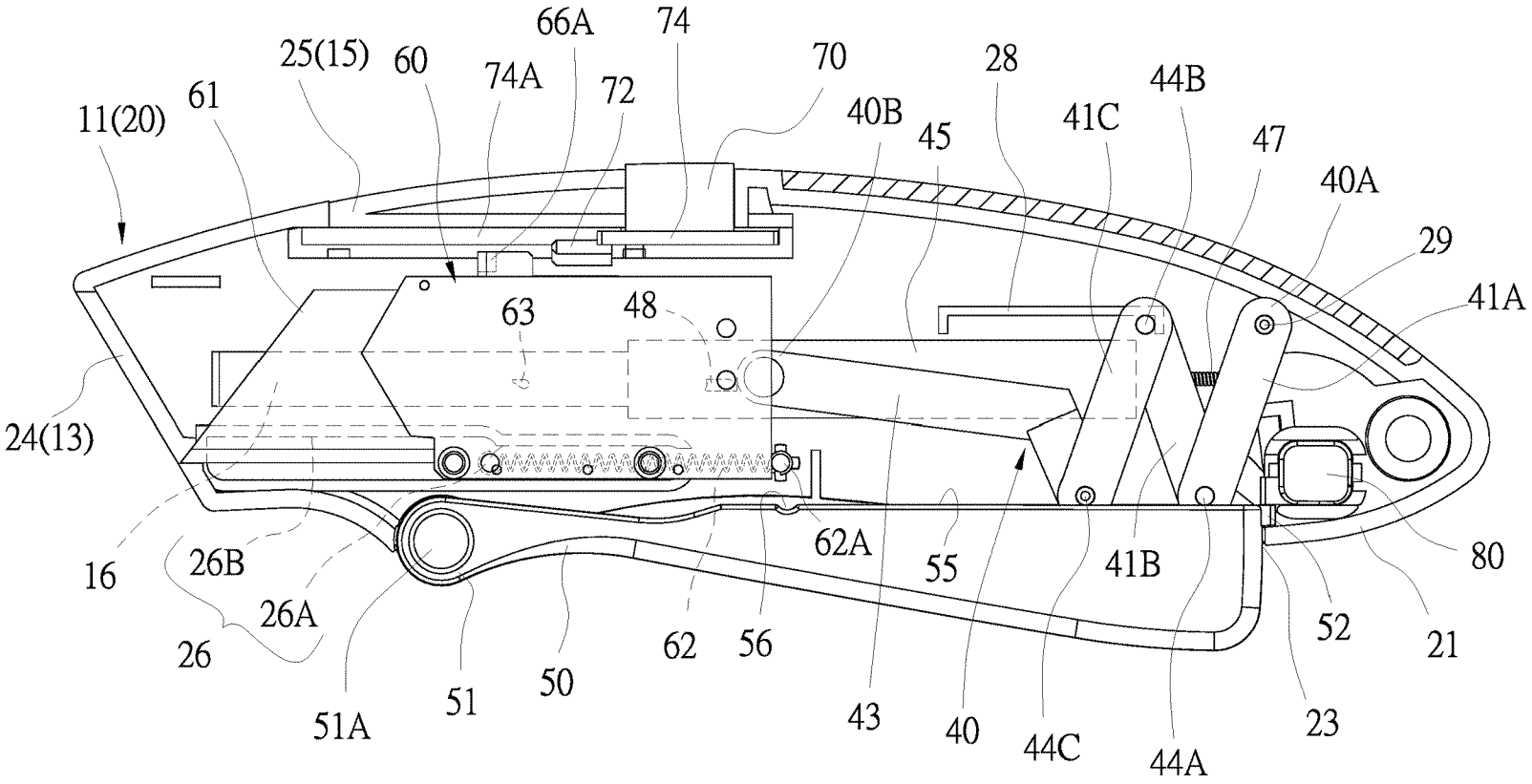
FIG. 3 is a cross-sectional view of the automatic retractable cutter shown in FIG. 1.
Figure 5:
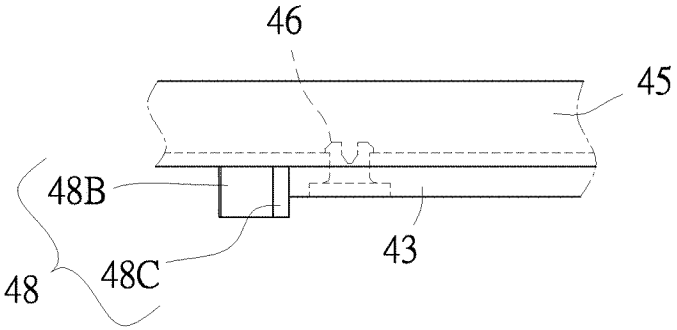
FIG. 5 is a partial, top view of the linkage connected to the sliding element shown in FIG. 4.
Figure 6:
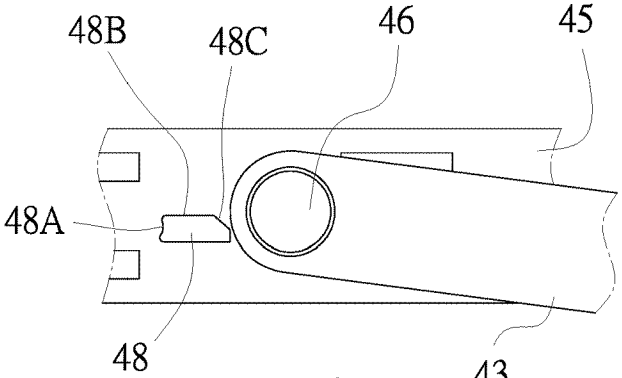
FIG. 6 is a partial, side view of the linkage connected to the sliding element o shown in FIG. 4.
Figure 4:
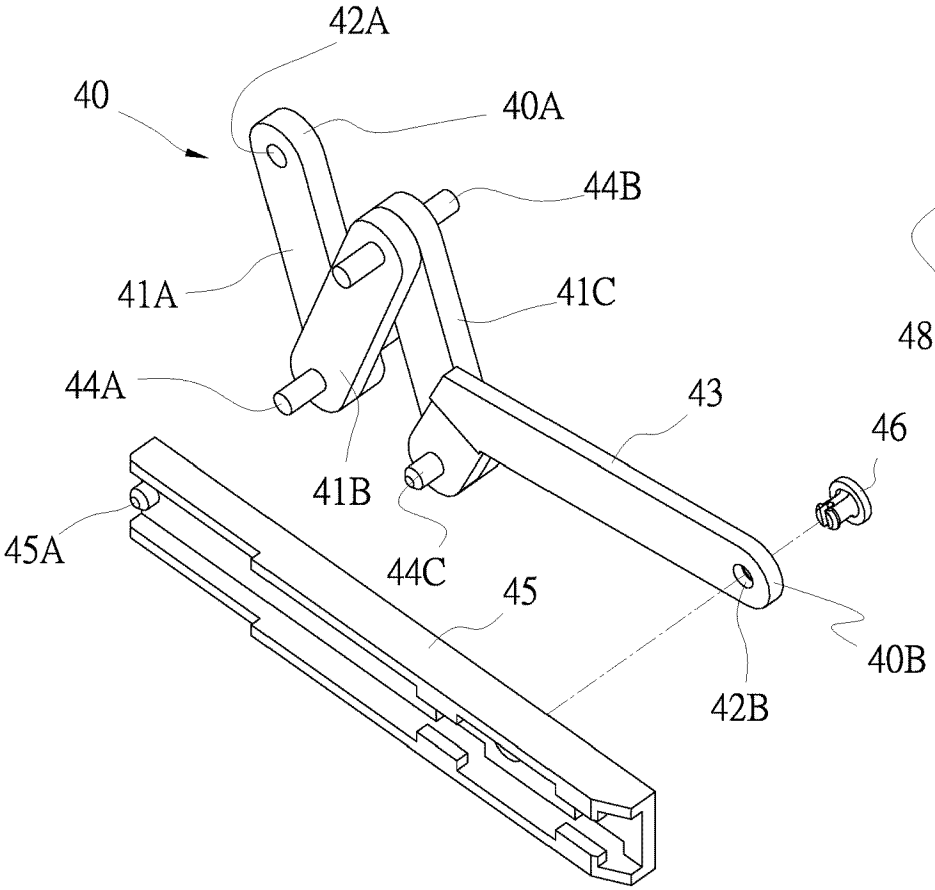
FIG. 4 is a perspective view of a linkage and a sliding element of the automatic retractable cutter shown in FIG. 1.
Figure 10:
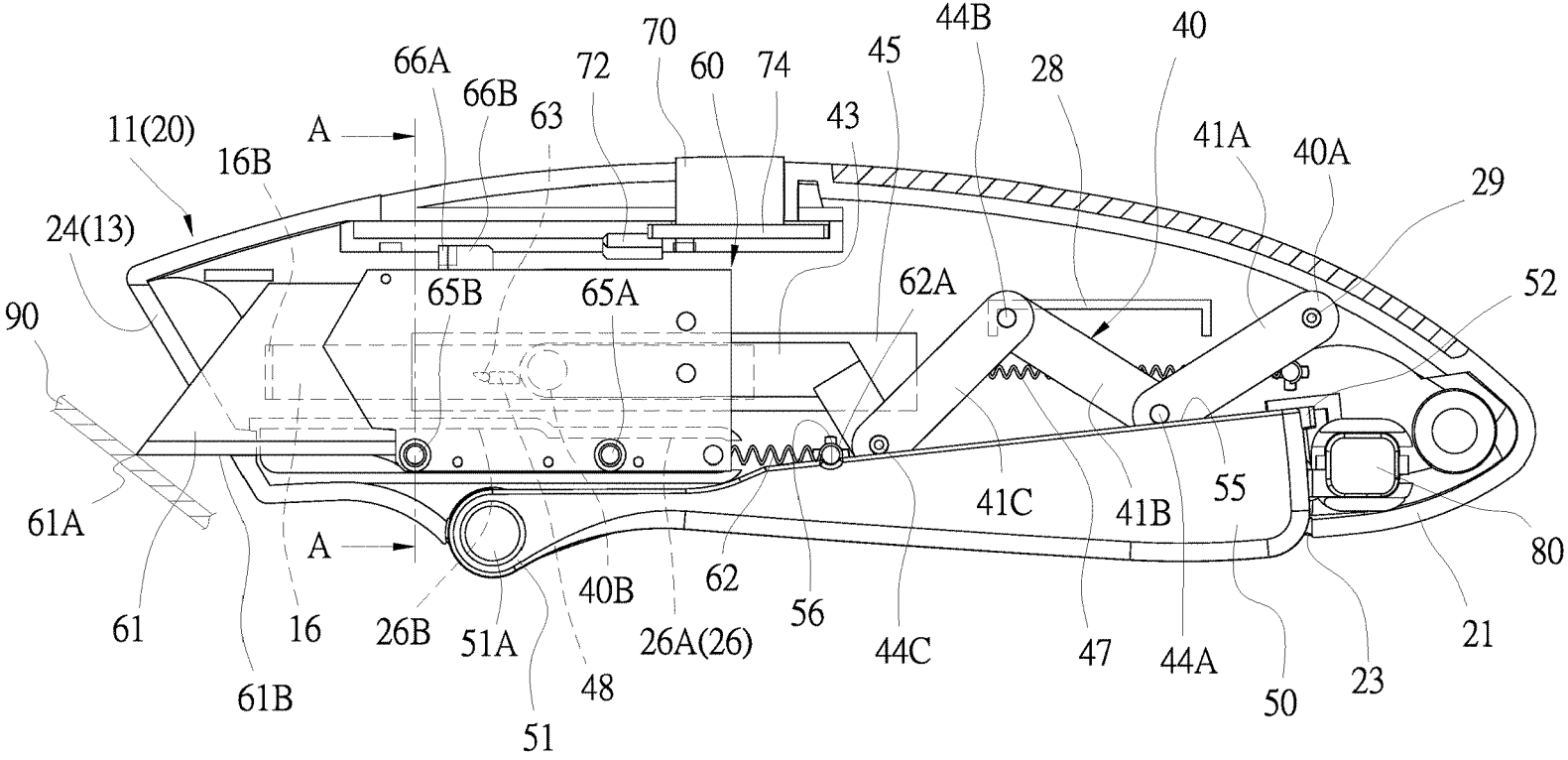
FIG. 10 is a cross-sectional view of the automatic retractable cutter in another position than shown in FIG. 3.
Figure 11:
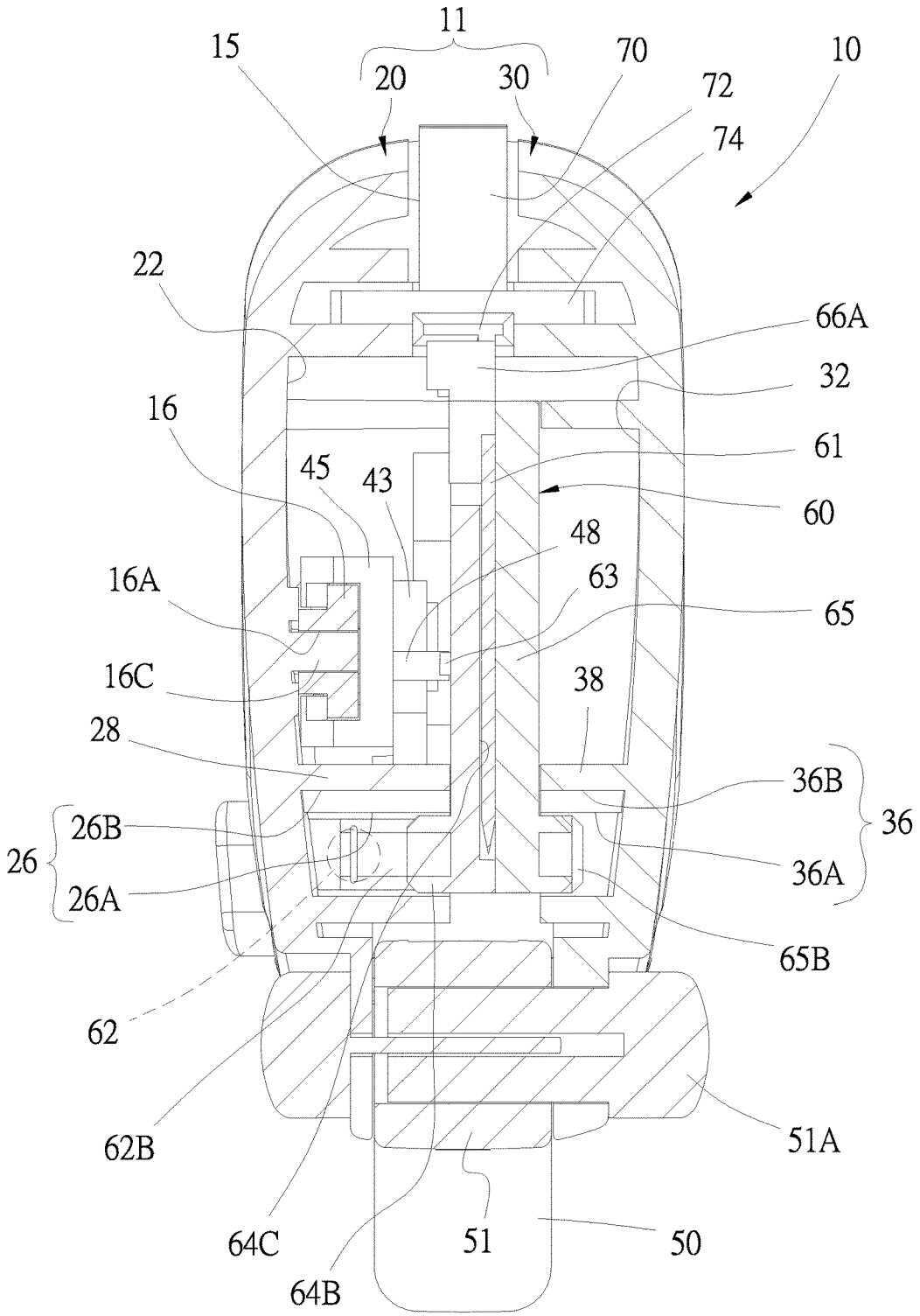
FIG. 11 is a cross-sectional view of the automatic retractable cutter taken along a line A-A shown in FIG. 10.

Referring to FIGS. 3, 10 and 11, the linkage 40 connects the sliding element 45 to the lever 50 so that the lever 50 is operable to move the sliding element 45 via the linkage 40. To this end, the linkage 40 includes an initial end 40A connected to the shell 20 and a final end 40B connected to the sliding element 45. The linkage 40 includes three short bars 41A, 41B and 41C and a long bar 43. An end of the short bar 41A is taken as the initial end 40A of the linkage 40. Near the initial end 40A of the linkage 40, the short bar 41A includes an aperture 42A for receiving a section of a stem 29 formed on the internal face of the shell 20 so that the short bar 41A is pivotally connected to the shell 20. Another section of the stem 29 is inserted in an aperture 39 made in the shell 30. The short bar 41B is pivotally connected to the short bar 41A by a pin 44A. The short bar 41C is pivotally connected to the short bar 41B by a pin 44B. The long bar 43 is pivotally connected to the short bar 41C by a pin 44C. An end of the long bar 43 is taken as the final end 40B of the linkage 40. A fastener 46 includes a section inserted in an aperture 42B made in the long bar 43 and another portion inserted in an aperture (not numbered) made in the sliding element 45.

Referring to FIGS. 2 and 3, the lever 50 includes a lug 51, a block 52, a cavity 53 and two walls 54. The lug 51 is formed at an end of the lever 50. The block 52 is formed at another end of the lever 50. The walls 54 are formed between the lug 51 and the block 52. The cavity 53 is made by the lug 51, the block 52 and the walls 54. Each of the walls 54 is formed with an upper edge 55.

The lug 51 is pivotally connected to the shells 20 and 30 of the handle 11 by a fastener 51A, thereby rendering the lever 50 rotatable in the opening 14. The block 52 is used to abut against a portion of the handle 11 to limit rotation of the lever 50 relative in the handle 11 in a range. The lever 50 includes a portion inserted in the handle 11 via the opening 14 and another portion located out of the handle 11.

The cavity 53 receives a section of each of the short bars 41A, 41B and 41C and a portion of the long bar 43. The upper edges 55 of the lateral walls 54 movably support the pins 44A and 44C. As mentioned above, the spring 47 tends to keep the sliding element 45 in the rear position, the sliding element 45 tends to shrink the linkage 40, and the linkage 40 tends to pivot the lever 50 to a lower position.

Figure 7:
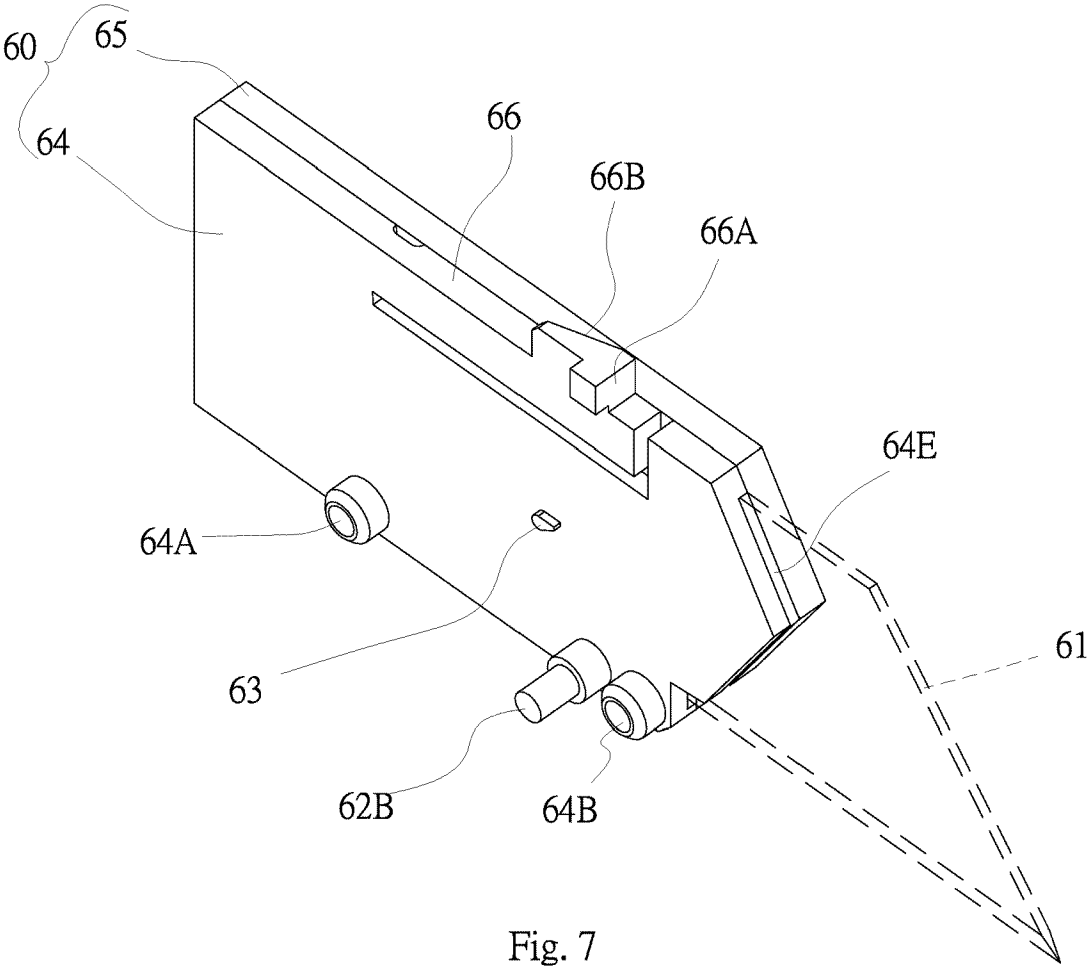
FIG. 7 is a perspective view of a cassette of the automatic retractable cutter shown in FIG. 4.
Figure 9:
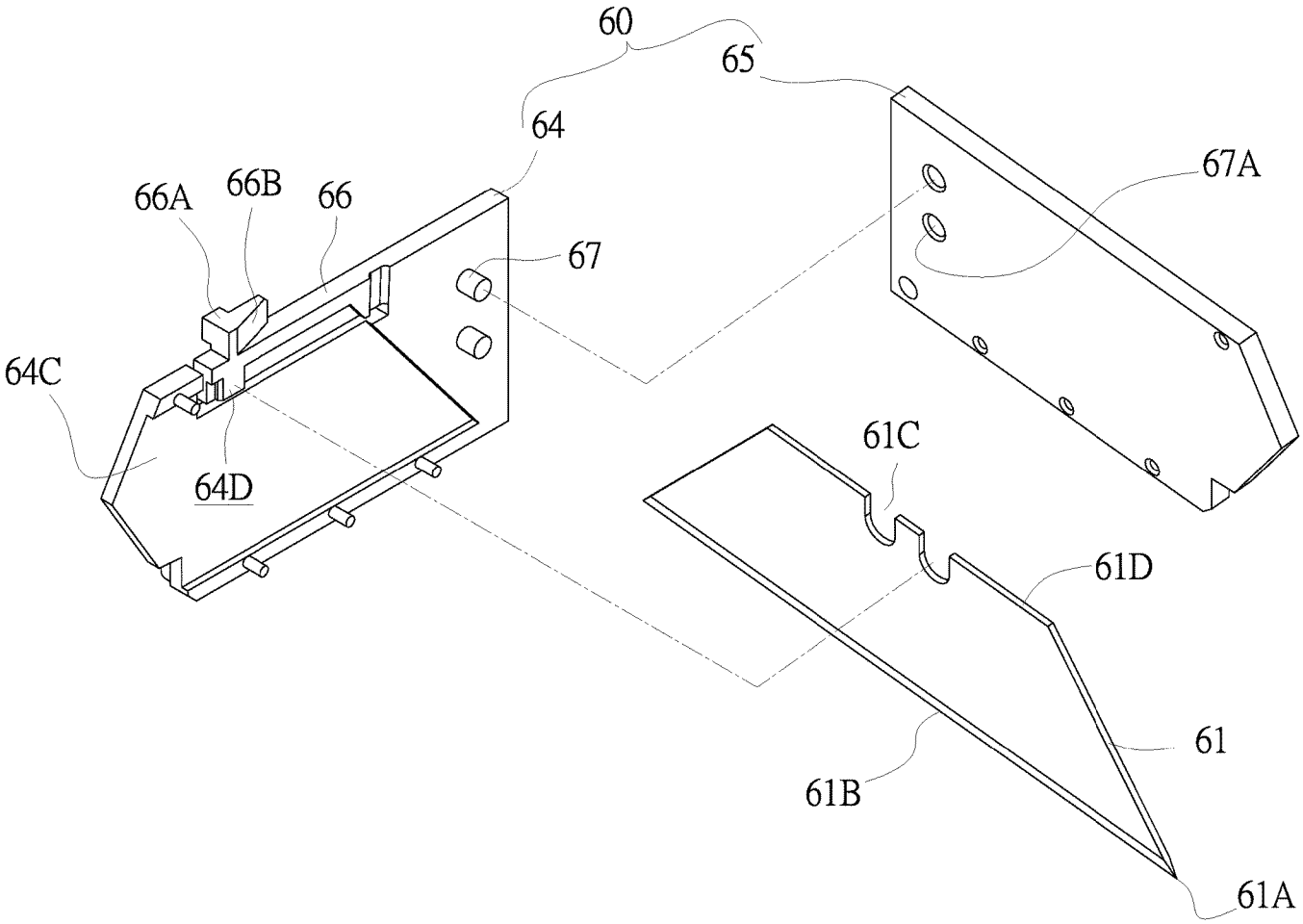
FIG. 9 is an exploded view of a cassette of the automatic retractable cutter shown in FIG. 7.

Referring to FIGS. 7 and 9, the cassette 60 includes a primary plate 64 connected to a secondary plate 65. The primary plate 64 includes a cavity 64C, a catch 64D, an elastic strip 66 and several stems 67. The cavity 64C is made in an internal face of the primary plate 64. The elastic strip 66 extends from an upper edge of the primary plate 64, and includes a button 66A formed on an upper face thereof, an inclined guiding face 66B formed on the button 66A, and a catch 64D extending in the cavity 64C from a lower face thereof. The stems 67 are formed on the internal face of the primary plate 64.

The secondary plate 65 includes several bores 67A. The stems 67 are inserted in the bores 67A to connect the primary plate 64 to the secondary plate 65. Thus, the cavity 64C is covered, and the cassette 60 is made with a slot 64E in communication with the cavity 64C. The blade 61 can be inserted in the cavity 64C via the slot 64E.

Referring to FIGS. 2 and 10, the switch 70 is formed with a flat base 74. A pusher 72 extends from a front edge of the flat base 74.

Figure 16:
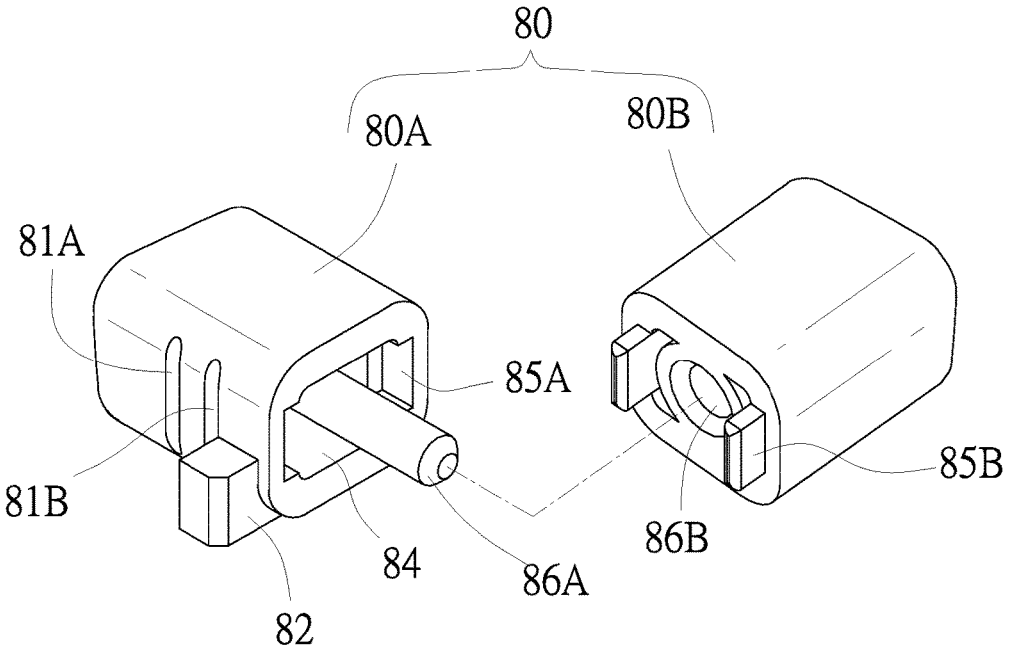
FIG. 16 is an enlarged exploded view of a switch of the automatic retractable cutter shown in FIG. 1.
Figure 17:
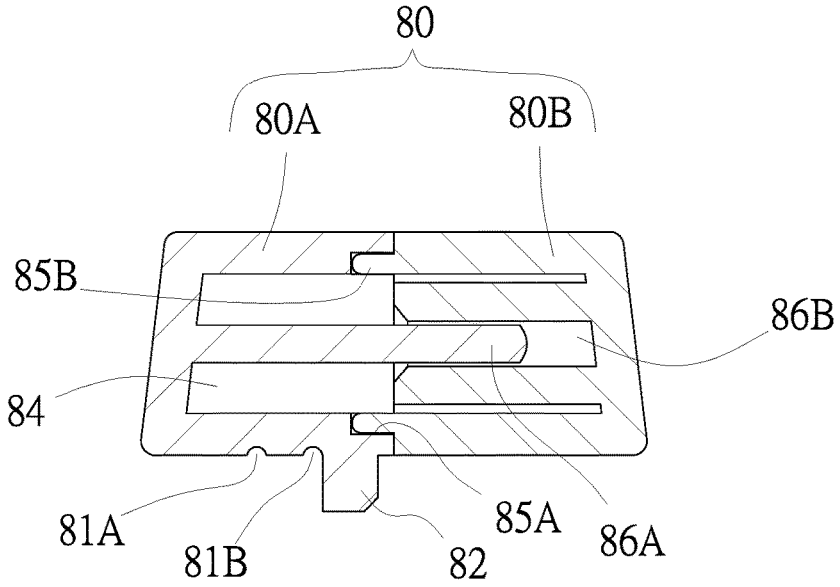
FIG. 17 is a cross-sectional view of the switch shown in FIG. 1.

Referring to FIGS. 16 and 17, the safety element 80 includes two shells 80A and 80B. The shell 80B includes two tabs 85B and a bore 86B. The bore 86B is located between the tabs 85B.

The shell 80A includes a space 84, two dents 85A and a rod 86A. The dents 85A are made in the wall of the space 84. The rod 86A is located in the space 84, between the dents 85A.

The rod 86A is fitted in the bore 86B. The tabs 85B are fitted in the dents 85A. Thus, the shells 80A and 80B are interconnected. An adhesive can be provided between the shells 80A and 80B to enhance the interconnection of the shells 80A and 80B.

Preferably, the shell 80A further includes two recesses 81A and 81B and a boss 82. The recesses 81A and 81B are made in an external face of the shell 80A. The boss 82 is formed on the external face of the shell 80A. However, in another embodiment, the recesses 81A and 81B can be made in the shell 80B instead of the shell 80A, and the latch 82 can be formed on the shell 80B instead of the shell 80A.

The cassette 60 is movably inserted in the handle 11. The cassette 60 extends substantially parallel to the sliding element 45, at a distance from each other. To this end, the cassette 60 is formed with two bosses 64A and 64B on a lateral face and two bosses 65A and 65B on another lateral face. The bosses 64A and 65A are movably inserted in the narrow sections 26A and 36A of the grooves 26 and 36, respectively. The bosses 64A and 65A are made with a diameter substantially identical to the width of the narrow sections 26A and 36A of the grooves 26 and 36 to ensure smooth sliding of former in the latter. The ribs 28 and 38 prevent the cassette 60 from pivoting laterally in the handle 11. The bosses 64B and 65B are movably inserted in the wide sections 26B and 36B of the groove 26 and 36, respectively. The bosses 64B and 65B are made with a diameter smaller than the width of the wide sections 26B and 36B of the groove 26 and 36 to allow the cassette 60 to pivot up and down in the handle 11 in a range.

A spring 62 is inserted in the groove 26 of the shell 20. The spring 62 includes an end connected to a stem 62B (FIG. 7) formed on one of the lateral faces of the cassette 60 and another end connected to a stem 62A formed on the internal face of the shell 20. The spring 62 tends to move the cassette 60 toward the stem 62A. Moreover, the spring 62 tends to pivot the cassette 60 downwards. The stem 62A is at a distance from the narrow section 26A of the groove 26. Each of the lateral walls 54 includes a recess 56 made in the upper edge 55. The recesses 56 are used to receive the stem 62A so that the pivoting of the lever 50 cannot be hindered by the stem 62A.

Figure 8:
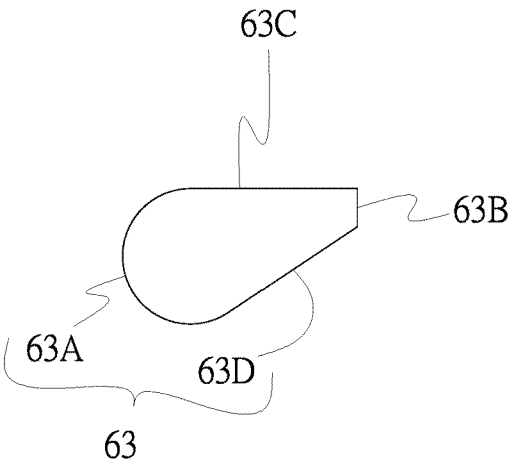
FIG. 8 is an enlarged partial view of a catch of the cassette shown in FIG. 7.

The sliding element 45 is used to move the cassette 60. To this end, the sliding element 45 includes a fin 48 (FIGS. 5 and 6) and the cassette 60 includes a catch 63 (FIGS. 7 and 8). The fin 48 includes a concave face 48A, an upper face 48B and a slope 48C. The concave face 48A is made at an end of the sliding element 45 near the catch 63. The slope 48C is made at another end of the sliding element 45 near the fastener 46 so that the connection of the sliding element 45 with the linkage 40 is not hindered. The catch 63 includes a convex rear face 63A, a flat front face 63B, a flat upper face 63C and an inclined lower face 63D. The convex face 63A is shaped compliant to the concave face 48A. The flat upper face 63C can be replaced with a concave or convex face in another embodiment.

Two lateral edges (not numbered) of the flat base 74 of the switch 70 are movably inserted in the grooves 74A and 74B so that the switch 70 is movable in and along the slit 15. Moreover, an upper portion of the switch 70 is located out of the handle 11 via the slit 15.

In the rear position, the long bar 43 and the sliding element 45 are kept near the short bar 41A by the spring 47. Thus, the final end 40B is kept near the initial end 40A, i.e., the linkage 40 is at a minimum effective length. Hence, the fin 48 is separated from the catch 63, and the catch 63 is on the way of the fin 48 to the front position.

Referring to FIG. 3, the lever 50 is not pivoted in the handle 11 so that the spring 47 pulls the sliding element 45 to the rear position. Thus, the linkage 40 is at the minimum effective length. The lever 50 is kept out of the handle 11. Moreover, the spring 62 pulls the cassette 60 backwards in the handle 11 to retract the blade 61 into the handle 11.

Referring to FIG. 10, the lever 50 is pivoted toward the interior of the handle 11, thereby moving the pins 44A and 44C, i.e., extending the linkage 40 against the spring 47. Accordingly, the sliding element 45 is moved toward the slot 13 of the handle 11. The lever 50 is stopped by the stem 62A when the stem 62A is inserted in the recess 56 of the lever 50. Hence, the sliding element 45 is stopped and kept in the front position. In the front position, the sliding element 45 may or may not abut against the stop 16B of the track 16.

The fin 48 is moved toward the catch 63 while the sliding element 45 is moved to the front position from the rear position. After the fin 48 reaches the catch 63, the sliding element 45 moves the cassette 60 toward the cutout 24 of the shell 20 so that the tip 61A and a portion of the cutting edge 61B of the blade 61 extend out of the handle 11 via the slot 13. In the front position, the final end 40B of the long bar 43 is far from the initial end 40A of the short bar 41A, i.e., the linkage 40 is at a maximum effective length.

In the front position, the concave face 48A of the fin 48 abuts against the convex face 63A of the catch 63. Hence, the sliding element 45 moves the cassette 60 forwards, thereby extending the spring 62. Now, the tip 61A or the cutting edge 61B of the blade 61 can be used to cut an object 90 such as a cardboard. The blade 61 and the cassette 60 can be pivoted about the bosses 64A and 65A. The pivoting of the blade 61 and the cassette 60 is limited in a range since the bosses 64B and 65B are allowed to move transversely a little in the large sections 26B of the groove 26.

Figure 12:
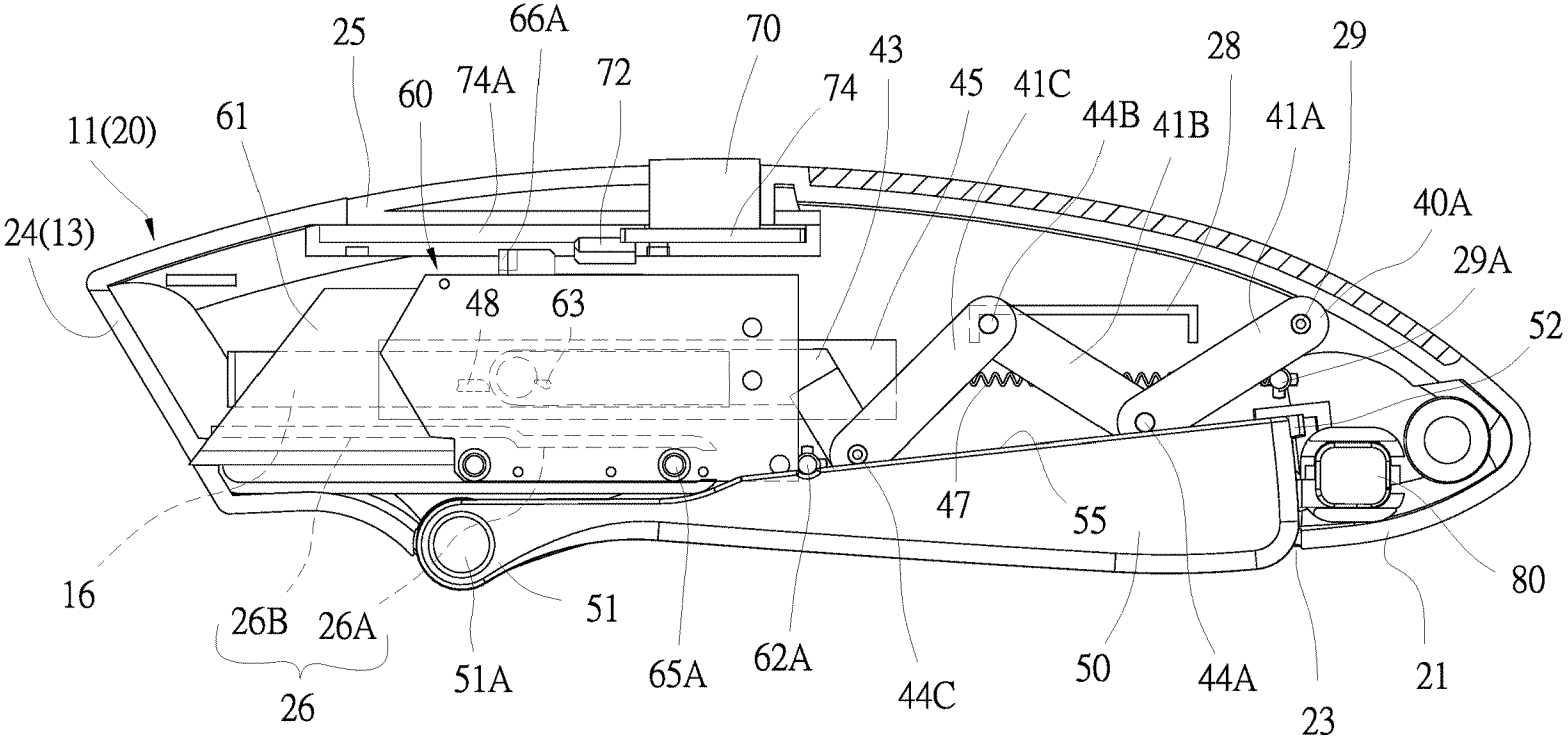
FIG. 12 is a cross-sectional view of the automatic retractable cutter in another position than shown in FIG. 10.

The blade 61 and the cassette 60 tend to be pivoted about the bosses 64A and 65A if the tip 61A or the cutting edge 61B is pressed excessively hard on the object 90 and could cut excessively deep into the object 90. Inherently, the convex face 63A is allowed to side on the concave face 48A so that the blade 61 and the cassette 60 are allowed to be pivoted about the bosses 64A and 65A. Referring to FIG. 12, after the cassette 60 is pivoted about the bosses 64A and 65A for a certain angle, the catch 63 is disengaged from the fin 48, i.e., the convex face 63A is disengaged from the concave face 48A. The spring 62 is allowed to move the cassette 60 backwards so that the catch 63 is moved backwards past the upper face 48B and away from the fin 48. Finally, the blade 61 is retracted in the handle 11 while the sliding element 45 remains in the front position.

Referring to FIG. 11, the distance of the sliding element 45 from the cassette 60 is larger than the sum of the width of the long bar 43 and that of the catch 63. The distance of the sliding element 45 from the cassette 60 is smaller than the sum of the width of the fin 48 and that of the catch 63. Preferably, the distance of the sliding element 45 from the cassette 60 is substantially identical to the width of the fin 48 that is larger than the width of the catch 63. Thus, the fin 48 is allowed to contact the catch 63 when the sliding element 45 is on the way to the front position from the rear position.

Referring to FIG. 3, the lever 50 can be released to allow the sliding element 45 to return to the rear position. A front edge of the fin 48 reaches the fat face 63B of the catch 63 on the way of the sliding element 45 back to the rear position from the front position. Guided by the slope 48C, the fin 48 contacts and slides along the slope 63D, thereby lifting the catch 63, and pivoting the cassette 60. Hence, the returning of the sliding element 45 is not hindered.

Referring to FIG. 10, the guiding face 66B is away from the pusher 72 when the switch 70 is far away from the slot 13 of the handle 11. Hence, the catch 64D is located in the cavity 64C and inserted in one of the cutouts 61C of the upper edge 61D of the blade 61. Thus, removal of the blade 61 from the cassette 60 is prevented.

Figure 13:
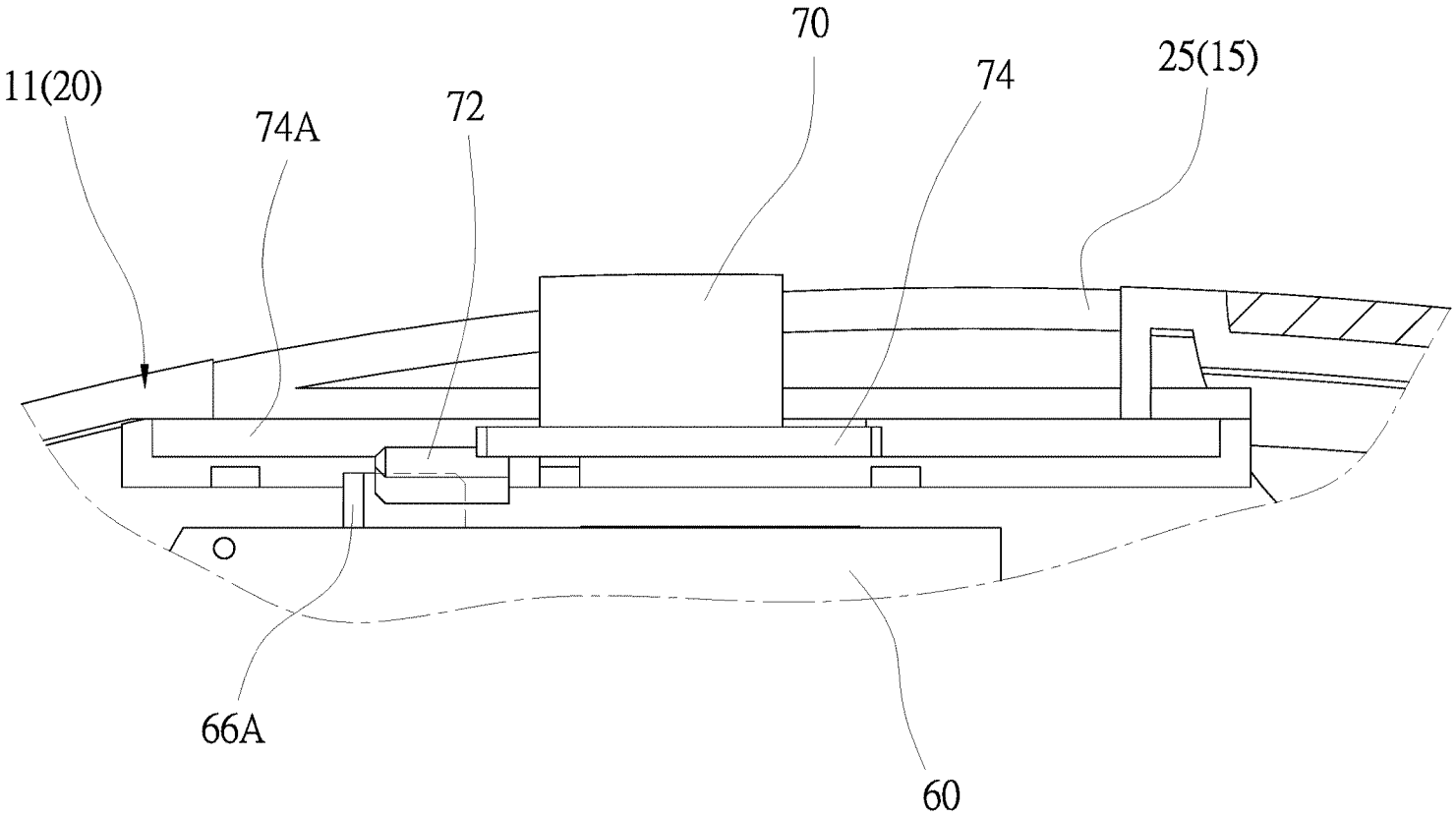
FIG. 13 is an enlarged partial view of the automatic retractable cutter in another position than shown in FIG. 12.
Figure 14:
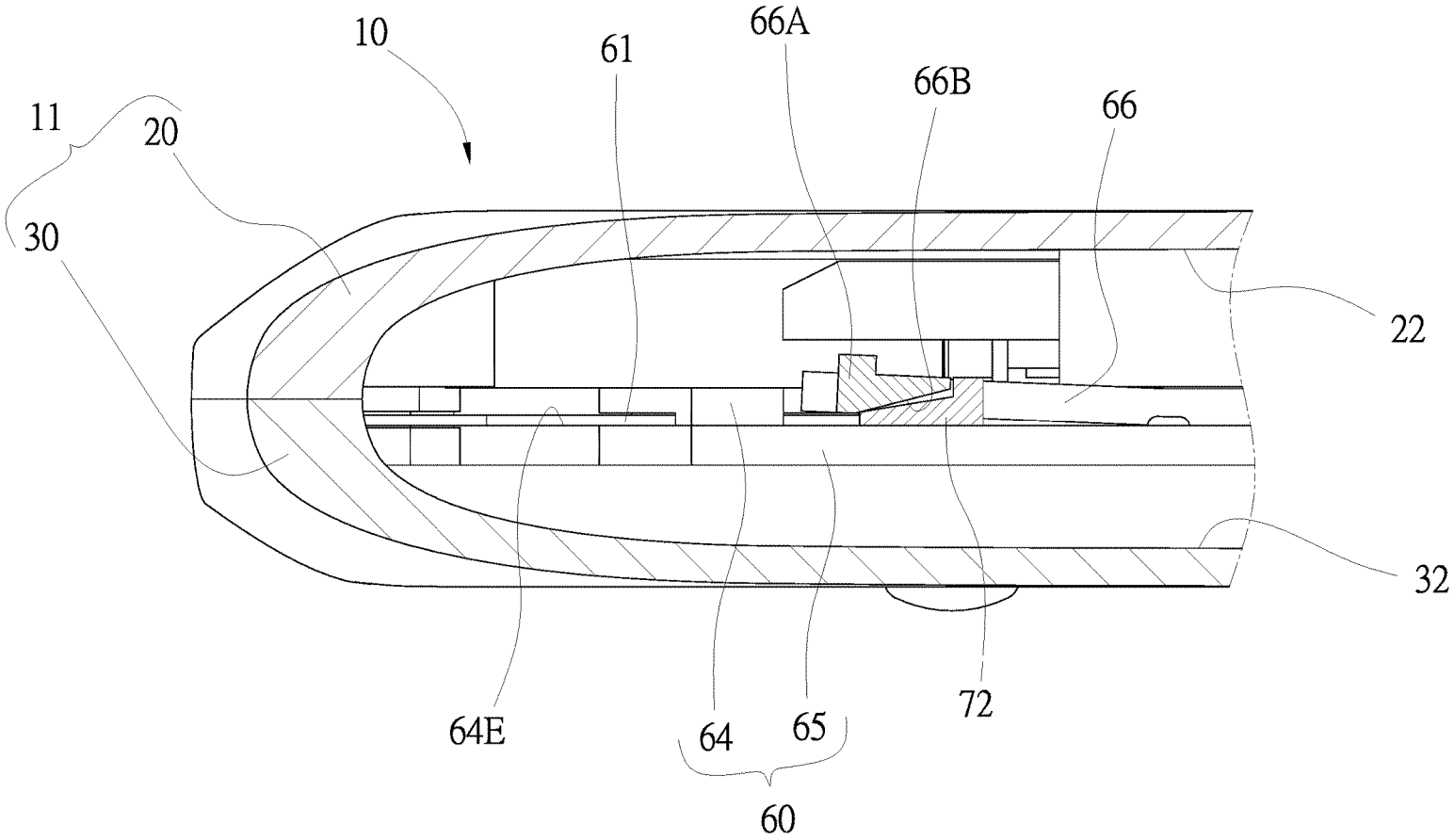
FIG. 14 is another cross-sectional view of the automatic retractable cutter taken shown in FIG. 13.

Referring to FIGS. 13 to 15, to replace the blade 61 with a new one, the sliding element 45 is located in the front position to locate the cassette 60 near the slot 13 of the handle 11, and the switch 70 is located near the slot 13. The pusher 72 slides against the guiding face 66B to bias the button 66A and the elastic strip 66. Accordingly, the catch 64D is removed from the cavity 64C. That is, the catch 64D is removed from any of the cutouts 61C. Hence, removal of the blade 61 from the cassette 60 is allowed before a new blade is inserted in the cavity 64C of the cassette 60 via the slot 64E and the slot 13 of the handle 11.

Referring to FIG. 10, the switch 70 is located far from the slot 13 so that the elastic strip 66 is allowed to bring the catch 64D back into the cavity 64C and one of the cutouts 61C. Thus, removal of the blade 61 from the cassette 60 is prevented.

The safety element 80 is substantially inserted in the handle 11. The shell 80A is inserted in the polygonal aperture 27 of the shell 20 while the shell 80B is inserted in the polygonal aperture 37 of the shell 30. The safety element 80 is movable in the polygonal apertures 27 and 37 between a releasing position (FIG. 18) and a locking position (FIG. 19).

In the releasing position, the latch 82 of the safety element 80 is located away from the block 52 of the lever 50. Hence, pivoting of the lever 50 toward the interior of the handle 11 is allowed. One of the recesses 81B of the safety element 80 receives the boss 27B of the positioning portion 27A to elastically keep the safety element 80 in the releasing position.

In the locking position, the latch 82 of the safety element 80 is in contact with the block 52 of the lever 50. Therefore, pivoting of the lever 50 toward the interior of the handle 11 is prevented. The other recess 81B of the safety element 80 receives the boss 27B of the positioning portion 27A to elastically keep the safety element 80 in the locking position.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A cutter comprising:

a handle comprising a slot in an end of the handle and two grooves in two opposite internal faces of the handle;

a cassette comprising:

a first pair of bosses inserted in the grooves to allow the cassette to translate and pivot in the handle; and a catch formed on the cassette;

a blade partially inserted in the cassette;

a sliding element formed with a fin, and movably inserted in the handle between a rear position where the fin is separated from the catch and a front position where the fin is in contact with the catch and the cassette is located closer to the slot than when the sliding element is in the rear position, wherein the catch is abutted against the fin so that the cassette is moved forwards in the handle by the sliding element during movement to the front position from the rear position;

a spring for connecting the sliding element to the handle, thereby biasing the sliding element toward the rear position;

a lever connected to the handle and operable to move the sliding element to the front position from the rear position; and a linkage for connecting the lever to the sliding element so that the lever is operable to move the sliding element via the linkage, wherein the linkage comprises:

a first bar pivotally connected to the handle;

a second bar, a third bar, a fourth bar;

a first pin for connecting the first bar to the second bar;

a second pin for connecting the second bar to the third bar, and a third pin for connecting the third bar to the fourth bar, wherein the first and third pins are in contact with and movable relative to the lever.

2. The cutter according to claim 1, wherein the fin is formed with a concave face, the catch comprises a convex face in contact with the concave face during the movement of the sliding element to the front position from the rear position, and the convex face is allowed to move relative to the concave face to allow the catch to leave the fin when the cassette is pivoted in the handle.

3. The cutter according to claim 2, wherein the fin is formed with a slope, the catch further comprises a slope next to the convex face, and the slope of the fin is slidable along the slope of the catch so that the fin lifts the catch during movement of the sliding element to the rear position from the front position.

4. The cutter according to claim 1, wherein each of the grooves comprises a narrow section and a wide section, the narrow section is in communication with the wide section, the first pair of bosses is inserted in the narrow sections of the grooves, and the cassette further comprises a second pair of bosses inserted in the wide sections of the grooves.

5. The cutter according to claim 4, wherein the first pair of bosses is prevented from transverse movement in the narrow sections of the grooves while the second pair of bosses is transversely movable in the wide sections of the grooves.

6. The cutter according to claim 1, further comprising a spring for connecting the cassette to the handle, thereby biasing the cassette backwards into the handle.

7. The cutter according to claim 6, wherein the handle further comprises a stem connected to an end of the spring, and the cassette further comprises a stem connected to another end of the spring.

8. The cutter according to claim 1, wherein the handle further comprises an opening for receiving the lever.

9. The cutter according to claim 1, further comprising a safety element movably connected to the handle between a locking position for preventing pivoting of the lever toward the handle and a releasing position for allowing the pivoting of the lever toward the handle.

10. The cutter according to claim 1, wherein the lever comprises a lug formed at an end of the lever and a fastener inserted in the lug and the handle.

11. The cutter according to claim 10, wherein the lever comprises a block for abutment against the handle to limit pivoting of the lever in a range.

12. The cutter according to claim 1, wherein the cassette comprises:

a primary plate comprising a cavity;

a secondary plate connected to the primary plate to cover the cavity and provide a second slot in communication with the cavity; and an elastic strip extending from the primary plate and comprising a second catch for catching the blade, wherein the second catch is disengaged from the blade when the elastic strip is pivoted.

13. The cutter according to claim 12, further comprising a switch movably supported on the handle and operable to pivot the elastic strip.

14. The cutter according to claim 13, wherein the switch comprises a pusher, the elastic strip further comprises a button formed with a guiding face, and the pusher is abutted against the guiding face so that the elastic strip is pivoted when the switch is moved toward the second slot.

* * * * *